US009460695B2

(12) United States Patent
Szalay et al.

(10) Patent No.: US 9,460,695 B2
(45) Date of Patent: Oct. 4, 2016

(54) SYNTHESIZER WITH BI-DIRECTIONAL TRANSMISSION

(71) Applicant: Fishman Transducers, Inc., Andover, MA (US)

(72) Inventors: Andras Szalay, Budaors (HU); Lawrence Fishman, Winchester, MA (US)

(73) Assignee: FISHMAN TRANSDUCERS, INC., Andover, MA (US)

( * ) Notice: Subject to any disclaimer, the term of this patent is extended or adjusted under 35 U.S.C. 154(b) by 19 days.

(21) Appl. No.: 14/159,961

(22) Filed: Jan. 21, 2014

(65) Prior Publication Data

US 2014/0202316 A1 Jul. 24, 2014

Related U.S. Application Data

(60) Provisional application No. 61/754,293, filed on Jan. 18, 2013.

(51) Int. Cl.

| | |
|---|---|
| ***G10H 3/00*** | (2006.01) |
| ***G10H 1/00*** | (2006.01) |
| ***G10H 3/18*** | (2006.01) |

(52) U.S. Cl.

CPC ..... *G10H 1/0066* (2013.01); *G10H 3/188* (2013.01); *G10H 2220/106* (2013.01); *G10H 2240/211* (2013.01)

(58) Field of Classification Search

CPC ..... G10H 1/0066; G10H 1/0058; G10H 2240/056; G10H 1/0008; G10H 2240/311; G10H 2240/211; G10H 3/18; G10H 1/0083; G10H 1/342; G10H 3/186; G10H 2240/031; G10H 1/368; G10H 2210/031; G10H 1/186; G10G 1/00; G09G 2370/16; G09G 3/002; G08C 23/04

See application file for complete search history.

(56) References Cited

U.S. PATENT DOCUMENTS

| | | | | |
|---|---|---|---|---|
| 5,576,507 | A | 11/1996 | LaMarra | |
| 5,834,671 | A | 11/1998 | Phoenix | |
| 7,304,232 | B1 * | 12/2007 | Nicholes | G10H 1/46 84/741 |
| 7,427,710 | B2 | 9/2008 | Hara | |
| 2002/0005108 | A1 * | 1/2002 | Ludwig | G10H 1/00 84/600 |
| 2002/0124715 | A1 * | 9/2002 | Fay | 84/645 |
| 2002/0178012 | A1 * | 11/2002 | Wang et al. | 704/503 |
| 2003/0172797 | A1 * | 9/2003 | Juszkiewicz | G10H 1/0058 84/601 |
| 2004/0187673 | A1 * | 9/2004 | Stevenson | G10H 1/02 84/737 |
| 2006/0124735 | A1 * | 6/2006 | Mizuno et al. | 235/382 |
| 2006/0196348 | A1 | 9/2006 | Cummings | |

(Continued)

OTHER PUBLICATIONS

VJ Franz K, "Mid Air Wireless MIDI MAudio-Unboxing and Demonstration," https://www.youtube.com/watch?v=DMoGWhha_2s. Mar. 2, 2010.

(Continued)

*Primary Examiner* — Marlon Fletcher
(74) *Attorney, Agent, or Firm* — Pearl Cohen Zedek Latzer Baratz LLP

(57) ABSTRACT

An audio or visual system may include an encoder to encode electrical signals generated by an instrument such as a stringed instrument to music control message data such as MIDI data. A first wireless transceiver coupled to the encoder may transmit the MIDI data to a second wireless transceiver. A processor, coupled to the second wireless transceiver, may produce media signals based on the MIDI data.

20 Claims, 9 Drawing Sheets

(56) References Cited

U.S. PATENT DOCUMENTS

| | | | | |
|---|---|---|---|---|
| 2007/0000375 | A1 | 1/2007 | Harrison | |
| 2007/0003073 | A1 | 1/2007 | Iriarte | |
| 2007/0227335 | A1* | 10/2007 | Fukada et al. | 84/600 |
| 2007/0234880 | A1 | 10/2007 | Adams et al. | |
| 2010/0037755 | A1* | 2/2010 | McMillen | G10H 1/125 84/645 |
| 2010/0234109 | A1 | 9/2010 | Chiu et al. | |
| 2011/0003638 | A1 | 1/2011 | Lee et al. | |
| 2011/0028218 | A1* | 2/2011 | Gomes et al. | 463/39 |
| 2011/0174138 | A1* | 7/2011 | Loh et al. | 84/645 |
| 2013/0087037 | A1* | 4/2013 | Dreher | 84/645 |
| 2014/0053712 | A1* | 2/2014 | Dreher | 84/645 |
| 2014/0123838 | A1* | 5/2014 | D'Amours | 84/626 |
| 2014/0202316 | A1* | 7/2014 | Szalay | G10H 1/0066 84/645 |

OTHER PUBLICATIONS

Tetrastyle, "Wireless MIDI Transmitting by XBee (experiment)" https://www.youtube.com/watch?v=DMoGWhha_2s. May 26, 2011.

Pandamidi Solutions "midiBeam" http://web.archive.org/web/20131211070233/http://pandamidi.com.midibeam/ Dec. 11, 2013.

* cited by examiner

SYNTHESIZER WITH BI-DIRECTIONAL TRANSMISSION

PRIOR APPLICATION DATA

This application claims the benefit of prior U.S. Provisional Application Ser. No. 61/754,293, filed Jan. 18, 2013, which is incorporated by reference herein in its entirety.

FIELD OF THE PRESENT INVENTION

The present invention relates to guitar synthesizers or other synthesizers that may be played with other instruments.

BACKGROUND

Keyboard synthesizers may be well-known tools for creating music control message data such as MIDI data or notes that may be converted to synthesized or sampled sounds. For guitar synthesizers or other instruments, the setup may be more complicated. For example, on a guitar, a separate MIDI converter box may be coupled directly to the guitar through a cord. The connection between the guitar and the external box can be a multiplexed analog signal (as used by the Shadow GTM-6 and Passac Sentient Six MIDI controller boxes) or a unique multi-wire cable (such as WL Pitchrider, Korg Z3, and K-Muse Photon MIDI controllers), a standard 24 pin multi-wire cable (such as Roland or Ibanez IMG-2010 MIDI controller boxes), or a 13 pin cable (such as Yamaha G50 or Axon MIDI controller boxes). However, during performance, musicians may be tethered to these kinds of boxes. A way to allow a musician's freedom during performance and maintain low latency in converting sounds to MIDI may be needed.

SUMMARY

An audio or visual system may include an encoder to encode electrical signals generated by an instrument to music control message data such as MIDI data. A first wireless transceiver coupled to the encoder may transmit the MIDI data to a second wireless transceiver. A processor, coupled to the second wireless transceiver, may produce media signals (e.g. audio signals, video) based on the MIDI data.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
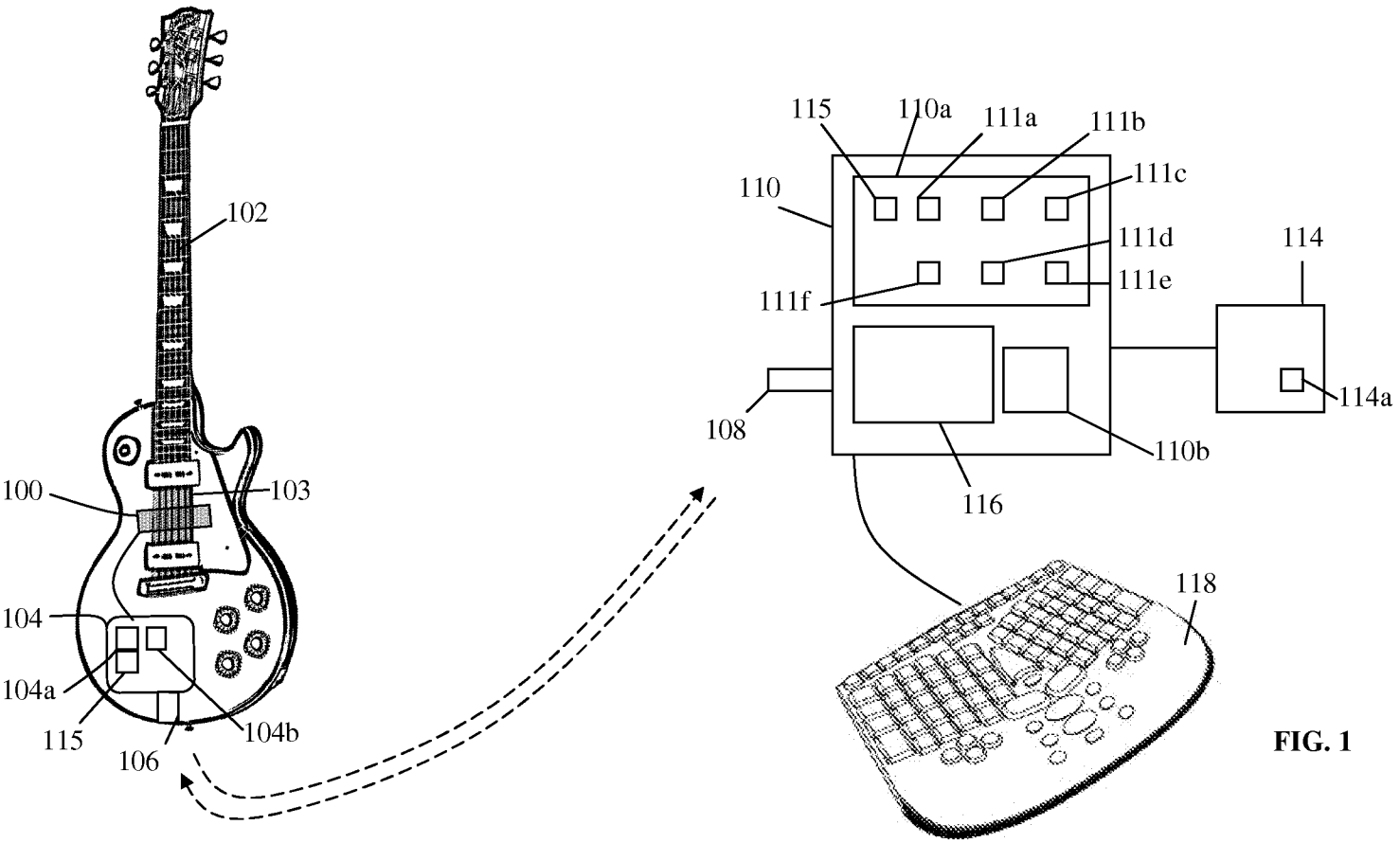
FIG. 1 is a diagram of an audio or visual system, according to embodiments of the invention.

It will be appreciated that for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION

In the following description, various aspects of the present invention will be described. For purposes of explanation, specific configurations and details are set forth in order to provide a thorough understanding of the present invention. However, it will also be apparent to one skilled in the art that the present invention may be practiced without the specific details presented herein. Furthermore, well known features may be omitted or simplified in order not to obscure the present invention.

Unless specifically stated otherwise, as apparent from the following discussions, it is appreciated that throughout the specification discussions utilizing terms such as "processing," "computing," "calculating," "determining," or the like, refer to the action and/or processes of a computer or computing system, or similar electronic computing device, that manipulates and/or transforms data represented as physical, such as electronic, quantities within the computing system's registers and/or memories into other data similarly represented as physical quantities within the computing system's memories, registers or other such information storage, transmission or display devices.

Embodiments of the invention may provide a system or method for producing media signals based on an instrumentalist's actions on an instrument, including an acoustic, electrical, or electronic musical instrument, such as an electric guitar, acoustic guitar, electric bass, acoustic violin, flute, or clarinet, for example. The media signals may be audio or video that may be samples from existing recordings, audio signals synthesized using synthesizing hardware or software, signals that direct a configuration of lighting effects on stage, or other signals that may control or direct an audiovisual performance or display. Actions on an instrument may be converted to data that conform to a format such as a standard Music Instrument Digital Interface (MIDI) format, an electronic musical instrument industry data format specification that enables a wide variety of digital musical instruments, computers, synthesizers, and other related devices to connect and communicate with one another. The data or MIDI data may include information about pitch, volume, and a length of time that a sound is sustained, for example. The musical usage of a guitar synthesizer system may require a complex structure of parameters that determine how the sound responds to the actions of the guitarist. Such a set of parameters may describe splits between different sounds according to the fret range or the string range that is played, the response to picking strength, or the limit of picking which triggers a MIDI note at all, and many other parameters. Such a set is called in MIDI terminology for example "preset", or "patch", or "program". Musicians may use different patches typically for each song, but often several patches may be required even within one song. Within each patch, there may be multiple splits, which divide sound characteristics depending on which notes are played. For example, in one patch, a lower octave played may be characterized by piano sounds, and a high octave played may be characterized by violin sounds. Other configurations may be used. A set of parameters or patch may be data stored in a memory.

The produced media signals may be media samples or synthesized sounds that are controlled by the music control data (e.g. MIDI data), for example, and may be produced having different sound qualities from the instrument that the instrumentalist is playing on. For example, the instrumentalist may be playing on a guitar, and the actions on the guitar may be converted to MIDI data, and the MIDI data may be wirelessly transmitted and used to trigger or control a sampled or synthesized piano sound or a synthesized flute sound on another device. Other types of sound may be triggered or controlled, which may emulate other instruments, noise, speaking, or electronically generated sounds, for example. Video recordings or samples may also be triggered by the music control data, control signal, control message, or MIDI data. For example, a guitarist's actions on the guitar may trigger certain video images to be displayed in desired parts of a song, for example. The music control data (e.g. control signal, control message or MIDI data) may control lighting effects on a stage, such as laser light effects, strobe light effects, color effects, or other lighting effects that may be seen during a performance. Data formats for communicating with devices including music or note information or control messages (e.g., event messages specifying notation, pitch and velocity, control signals for parameters such as volume, vibrato, audio panning, cues, and clock signals) other than MIDI may be used.

A synthesizer, e.g., a MIDI synthesizer, for example, may receive music data or note information such as MIDI data and output audio signals. Other musical or notation standards, or data formats for transmitting music or control messages, may be used. Though some embodiments described herein are directed primarily to a guitar, the claimed invention may be further applicable to other acoustic or electric musical instruments, whose sound may be converted to electrical signals through a guitar or other stringed instrument pickup, for example. Further, embodiments of the invention may allow wireless transmission of data between a musical instrument and a receiver which may be connected to a speaker or amplifier. Wireless transmission may occur over any wireless custom non-standard protocol, such as the consumer bandwidth of 2.4 GHz, or over a standard protocol, such as IEEE 802.11, Bluetooth, or Wi-Fi, for example, and may communicate over different radio bands, such as the industrial, scientific and medical (ISM) radio bands.

Embodiments of the invention may allow processing of analog audio signals for the output of MIDI data. The processing may occur on the musical instrument itself and the MIDI data output may be transmitted wirelessly to a speaker, amplifier, analyzer, or other equipment and output devices that may be able to further read and process MIDI data. The musical instrument may be equipped with a pickup. The pickup may be, for example, a magnet coil pickup, a piezoelectric pickup, a microphone, an accelerometer, an optical pickup, or any other device that translates vibrational information generated by the musical instrument into an electrical signal that is representative of the vibrations when measured as the magnitude of the signal with respect to time. The musical instrument may also be equipped with an encoder to encode or convert the electrical signals output by the pickup into MIDI data. The encoder may contain an analog to digital (A/D) converter (ADC) that converts the analog electrical signal to a digital format that is then that can then be processed by a digital signal processing (DSP) device, processor, or microprocessor, for example. Alternatively, the ADC may be coupled to the pickup. The analog processing on the encoder may process the electrical signals using a pitch detection algorithm that calculates the musical pitch produced by the musical instrument. This pitch information may be converted to a Midi Note Number, or other control message, that is wirelessly transmitted to the receiving device. This Midi Note Number may determine, for example, the pitch of the note that may be played by the sound producing device on the output module.

For stringed instruments, each string may have vibrations detected individually and may provide a data channel (e.g. a MIDI data channel or other music data channel) that can be processed independently from that of other strings. In particular, an electric guitar having six strings may provide six MIDI data channels. A pickup may sense or detect the vibrations on each of the six strings. The encoder may include six separate ADC's to convert each strings' vibrational information to a digital format, which may then be multiplexed or combined to be processed by the DSP. The fret or note positions on each string may be further divided into splits having different sound characteristics, for example. Unlike a piano keyboard, where each note can be programmed with MIDI information or messages, the same guitar note can be played on different strings (e.g., an A note at 220 Hz may be played on the second fret of the G string or the seventh fret on the D string), and it may not be practical for specific notes to be assigned different MIDI settings. Separately converting each string into MIDI data may provide a guitar player with a wide range of playability.

In addition to Midi Note Number, other control messages may be generated by the DSP that define the dynamic behavior of the note that is produced by the output module. This dynamic control information describes the musical nuances of the notes as they are played on the instrument. Examples of these control messages are: Pitch Bend or Velocity or specifying a particular instrument voice that should be played.

Parameters may further be defined that determine the way that the MIDI encoder or other music information encoder responds to the actions of an instrumentalist or player of an instrument (e.g. a guitarist). These parameters may set boundaries that are used by the (DSP or other processor coupled to the encoder) in determining the correct values that are output as control messages. Some examples of these boundaries may include: Note On value—what minimum excitation of the musical instrument that may represent a legitimate note on event, Note Off value—what minimum vibrational level that may determine a legitimate note off event, Pitch Bend range—how pitch modification may be produced by the sound producing module in response to the actual pitch bend produced on the musical instrument, Volume control messages—messages that may follow the envelope of the note produced by the musical instrument that are sent to the output device to control the volume of the sound produced, Quantization—settings that determine how to convert detected pitches that fall between conventional notes, or Dynamic Sensitivity, which may control how the encoder interprets volume variations in a musician's playing. The values of these parameters may be set according to the way the user plays an instrument or the way a user wants their playing to sound. These parameters may be global in nature such as general input sensitivity, tuning base (e.g., whether an A is at 440 Hz (A440) or 441 Hz (A441), etc.). These may also be specifically set to complement a particular sound that is being played, such as turning off pitch bend when playing a piano sound. The set of parameters that are not global may be assigned to a "preset," "patch," or other program that bundles these control messages with a particular sound that is assigned to a particular MIDI channel. These parameters or patches may be stored in memory in the encoder. The encoder may provide knobs and buttons or other controls to adjust the patches. Alternatively, the encoder may be in communication with a user interface separate from the encoder which allows a user to change parameters on the user interface. The patches may alternatively be stored in the memory of the output module and communicate wirelessly back to the encoder when a parameter value is changed.

Embodiments of the invention may allow editing or manipulation of the signals being transmitted from the guitar. The guitar may include an encoder which encodes signals from the guitar into MIDI data. The MIDI data may be sent wirelessly, e.g. via radio, to a computer or other device with editing or synthesizer software on it. The guitar itself may have knobs, buttons, and potentiometers that may manipulate sounds or audio signals produced by the guitar. One or more user interfaces may be provided which may be accessible through a computer. The user interface may indicate or visualize parameters that are being manipulated by the guitar or the computer itself. A transmitter and receiver may have the capability to communicate bi-directionally (each sending data to and receiving data from the other), as transceivers. The parameters stored in the encoder may be changed by controls on the encoder or by controls on the user interface couple to the receiver. When new parameters are to be stored in the encoder, the receiver may wirelessly transmit the new parameters to the encoder. The encoder may then save the new parameters. The parameters may be further stored in a memory coupled to receiver, such as the memory of a computing device. These parameters may be changed by the user interface or by controls on the encoder. When new parameters are to be stored in the user interface, the encoder may wirelessly transmit the new parameters to the computer. The computer may then save the new parameters. The parameters may be stored in the encoder and the computer simultaneously. The receiver (e.g., the receiver coupled to a computing device) may communicate with the transmitter through a protocol that reduces error in transmission. The protocol may allow full syncing of parameters between the encoder and the user interface.

A transmitter may be located on the musical instrument, and coupled to an encoder which converts electrical signals received from the pickup to MIDI data. The receiver may send an acknowledgement signal to the transmitter so that the transmitter can confirm that a connection exists between the receiver and the transmitter. The transmitter may be the device that always initiates communication with the receiver. The hardware in the transmitter and receiver may maintain low latency in creating and transmitting MIDI data, so that the guitarist or instrumentalist can maintain a natural feel of the instrument while performing or recording with the embodiments herein. A user may also initiate pairing between the transmitter and receiver.

Radio circuitry used may be capable of communicating in one direction at a time only, either as a transmitter or as a receiver. In case of the wireless guitar synthesizer only one direction may be primarily used, from the guitar towards the receiver box/sound generator, but a backwards communication may provide further benefits. Although it would be possible to construct a system that consists of a relatively "dumb" transmitter on the guitar, raw data may need to be modified according to the actual patch on the receiver side. This may have the consequence that the "intelligence" of the system is divided between the guitar device and the receiver. This may have several disadvantages: higher software development effort for each receiver option separately; higher cost for the receivers with stronger processors and larger memory; compromises that cannot be resolved, since some patch parameters (e.g. pick trigger sensitivity) must influence signal processing that may take place in the guitar. Instead, it may be more practical to concentrate the intelligence of the system in a central location, such as on the guitar unit. Thus, all kind of modifiers (foot switches, pedals, remote control) located on a receiver box may have a backwards data path into the central unit on a guitar. Patches may also be stored in the central unit, with a way to archive them on a computer, and it may be possible to reload them from the computer to the guitar using the backwards data path. Embodiments of the invention may encompass wireless unidirectional transmission of data (e.g., from a transmitter on a guitar to a receiver coupled to a receiver box or computer) or wireless bi-directional transmission of data (e.g., two way communication between a transmitter on a guitar and a receiver).

Most data transmission chipsets may include a way of handshaking between the transmitter and the receiver: the receiver may send back an acknowledge signal to the transmitter, so the transmitter can be sure that the message has arrived and does not have to be repeated. In the chipset used in some embodiments, there may be the additional possibility to hide a user message in the acknowledge signal. Thus, it is possible to send data backwards from the receiver to the transmitter, but communication may not be purely symmetrical: initiation may be only performed by the transmitter, and the receiver can pack its data in the answer to the initiation.

In the guitar synthesizer system the latency of the sounds may be a critical parameter, and may generally be kept to a minimum. If the latency of the backwards communication is also kept within reasonable limits (which does not have to be as small as for the transmitter-to-receiver communication) then the system may be just as usable as if it would have wired bi-directional connection. The reasonable latency for the backwards communication may be limited by real-time actions like pressing a foot switch, for example. If backwards communication (e.g., from the receiver box to the guitar) gets through with a latency of not more than about 10 milliseconds, then the sensation of latency may not appear for the guitarist; it may appear as real-time. Therefore, embodiments may be constructed in a way that if the transmitter has no data to send in a time of 7 milliseconds, then it may send out a dummy message, in order to provide a way for the receiver to send back its message. In this way, the receiver may send a new data package to the transmitter in not more than 7 milliseconds. At the same time the message from the transmitter may serve the purpose of sending out a "I am alive" message to the receiver ("Active Sensing" in MIDI terminology) that may provide a way to turn off hanging notes on the sound generators if communication between the transmitter and receiver breaks down for any reason. Other latencies may be used.

FIG. 1 is a diagram of an audio or visual system, according to embodiments of the invention. On an instrument 102 such as an electric guitar, a pickup 100 may detect vibrations from strings on the instrument 102 for example, due to the pickup's 100 close proximity to the instrument's 102 strings 103. The pickup 100 may convert these vibrations to electrical signals and send electrical signals to an encoder 104. The electrical signals may first be analog and processed through an analog/digital (A/D) converter to convert them to digital signals for further processing. The vibration of each string 103 may be processed through a separate ADC and then sent to a DSP. The encoder 104, including a memory 104*a* and processor 104*b*, may encode or convert the electrical signals from the pickup 100 into MIDI data or other kinds of musical note or music control messages or data. The encoder may include an A/D converter, or alternatively, the A/D converter may be located on the pickup 100. The encoder 104 may be coupled to a transmitter or transceiver 106. The transceiver 106 may transmit the MIDI data or music control messages or data wirelessly (e.g. via radio) to a receiver or a second transceiver 108. The receiver-transceiver 108 may be a Universal Serial Bus (USB) device connectable to a computer 110, for example. Alternatively, the receiver-transceiver 108 may be embedded in a stomp box or standalone receiver box.

The computer 110 may include memory 110*a* and a processor 110*b*. Memory 110*a* may store software such as a digital workstation 111*a*, audio editor 111*b*, and audio mixer 111*c*, for example. Memory 110*a* may also include software for synthesizers 111*d* or samplers 111*e*. Memory 110*a* may further include software for editing or visualizing MIDI parameters. Such programs may include or be compatible with Avid's Pro Tools, Apple's GarageBand and Logic software, Steinberg's Cubase software, Ableton Live software, and Presonus's Studio One software. The computer 110 may include a display 116 that allows or enables a user to edit MIDI parameters for encoding electrical signals from the pickup 100 to MIDI data. Processors 110*b* and 104*b* may each carry out all or part of embodiments of a method as discussed herein, or may be configured to carry out embodiments, for example, being associated with or connected to a memory 110*a* and 104*a* storing code or software which, when executed by the processor, cause the processor to carry out embodiments of the method.

The synthesizer 111*d* or sampler 111*e* may be separate or integrated with computer 110. The synthesizer 111*d* may generate, e.g. by processor 110*b*, media signals such as audio signals based on the received MIDI data or musical note or music control data or messages from the receiver 108 and the parameters selected on digital workstation 111*a*, such as which type of instrument sound to generate (e.g., electric violin). The sampler 111*e* may store a set of recorded sounds or video clips or other instructions (e.g. lighting control instructions) in memory and produce audio or video signals that replay the recorded sounds or video. The data received from receiver 108 may dictate which recorded sound to play. The digital workstation 111*a* may further control the way that the recorded sounds are played (e.g., with a high pass filter).

The computer 110 (e.g. via a user interface shown on display 116 or input devices such as a keyboard 118) may allow the setting of music control message data parameters (e.g. MIDI parameters) 115 such as for example volume or reverb, for example. These parameters 115 may be saved or stored in computer memory 110*a*. The computer 110 may further wirelessly transmit the music control message data or MIDI parameters 115 through receiver-transceiver 108 to transmitter-transceiver 106 on guitar 102. The parameters 115 may be stored onto the encoder's memory 104*a*. Thus, bi-directional data transmission may be possible between guitar 102 and computer 110. For example, a user on computer 110 may choose or decide that a C note played on a low E string should sound like an electric violin sound played at a high volume and sustained. The user may input the MIDI parameters 115 via an input device 118. The MIDI parameters 115 may be transmitted to transceiver 106 on guitar 102 and stored in the encoder's memory 104*a*. When the user plays the C note on the particular string (but not necessarily on another string of the same guitar), the pickup may detect the string's vibration and the encoder's ADC may convert the electrical signal to digital signal. The encoder's DSP may convert the digital signal and generate or create a MIDI message or control message indicating a C note that should be played like an electric violin with a high volume value and sustained. During play, the MIDI message may be transmitted from the transmitter-transceiver 106 to receiver 108. The synthesizer 111*d*, via processor 110*b*, may receive the MIDI message and generate an audio signal according to the MIDI message's instruction to an output device 114 (such as a speaker or amplifier) that sounds similar to an electric violin playing a C note loudly and for a longer time than is typical for the sound produced via one guitar pluck. Additionally, sampler 111*e* may produce video signals from stored video samples or other stored images (e.g., computer graphics) to output device 114. Output device 114 may include a display 114*a* to play video clips or signals based on music control data (e.g., control signals, control messages or MIDI messages) received by receiver 108.

Processor 110*b* may execute software or code to carry out embodiments of the invention. For example, processor 110*b* may act as synthesizers 111*d*, samplers 111*e*, workstation 111*a*, audio editor 111*b*, or audio mixer 111*c*. Computer 110 may be a typical consumer PC or other laptop with software loaded to it, or computer 110 may be a standalone computing device or receiver box that implements real-time audio mixing and editing tasks and may be particularly suited for use during musical performances, for example.

Figure 2:
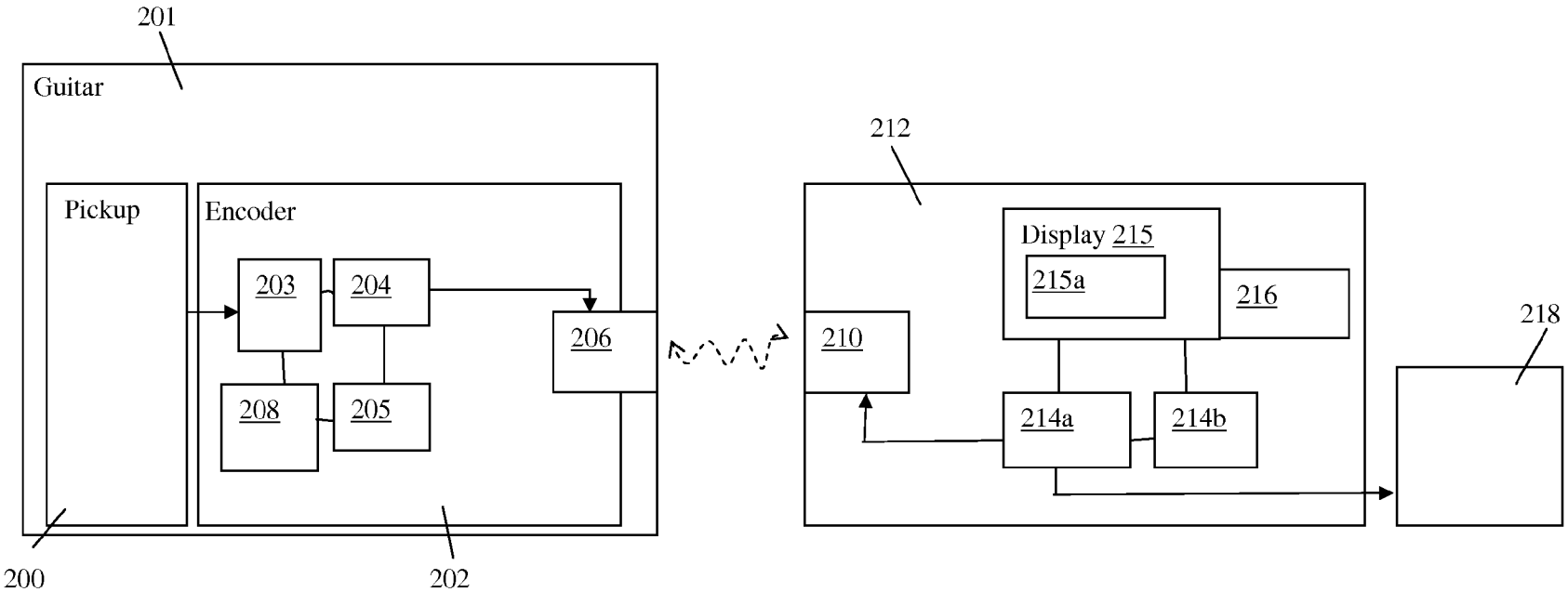
FIG. 2 is a schematic diagram of an audio or visual system using a standalone receiver box, according to embodiments of the invention.

FIG. 2 is a schematic diagram of an audio or visual system using a standalone receiver box, according to embodiments of the invention. Pickup 200 may send data from a guitar 201 to an encoder 202 which is also mounted on a guitar. Pickup 200 and encoder 202 may be removably attached to the guitar 201 during performance. Pickup 200 and encoder 202 may include adhesive material, such as glue or Velcro™, or be magnetic, and be able stick onto the guitar while a musician is playing. Pickup 200 and encoder 202 may be able to be removed if a musician does not wish to use the synthesizer system. Encoder 202 may alternatively be connectable to a standard pickup 200 that both may be originally manufactured with, embedded in, or integral to the guitar 201.

The encoder 202 may include an ADC 203 to convert analog electrical signals from the pickup 200 to digital data or signals. Encoder 202 may further include a processor 204 for processing the digital data from the ADC 203. The processor may convert or encode the digital data originating from the pickup 200 into MIDI data or other data. The encoder 202 may include memory 205 to store MIDI parameters that affect how digital data from the ADC 203 is converted to MIDI data. MIDI parameters may include, for example, volume, quantization, or pitch bends. The MIDI data may include information such as the frequency of a pitch and the length of time that a pitch is sustained. The encoder 202 may be coupled to a wireless (e.g., radio) transceiver 206. Control elements 208 may be included in the encoder 202 to select MIDI parameters or sets of MIDI parameters (e.g., patches) that affect the processing of audio data to MIDI data. The control elements 208 may include push buttons and potentiometers, for example.

The transceiver 206 may transmit or send MIDI data to a second (e.g., radio) transceiver 210. The receiver may be integrated in a stomp box or standalone receiver box 212. The receiver box 212 may be a standalone device with a processor 214*a* and memory 214*b*. The receiver box 212 may include switches and pedals or other control elements 216 to control functions such as hold, arpeggio, looper, or other patches or sets of MIDI parameters. The receiver box 212 may be configured or optimized for easy use during performance. The receiver box 212 may be connected to a synthesizer 218 to generate sounds based on the received MIDI data and patches enabled by the switches on the stomp box 212. The stomp box may include a display 215 that includes or generates a user interface 215*a* to display information and allow a user to edit or manipulate the MIDI data received by the receiver. The user interface 215*a* including a touch pad or other inputs may further allow a user to edit MIDI parameters for encoding electrical signals to MIDI data and to allow a user to transmit a set of MIDI parameters to the encoder 202. Alternatively, controls 216 may be integrated with user interface 215*a* and vice versa. Encoder 202 may store the received MIDI parameters from receiver box 212 as separate sets or patches in memory 205. During performance, for example, a musician may quickly select different patches stored in memory 205 through manipulating controls 208. In another example, patches may be saved in memory 214*b* on receiver box 212, and a musician may manipulate controls 216 on the receiver box to access different patches saved in the encoder's 202 memory. In this way, embodiments of the invention may allow syncing of MIDI parameters between the encoder 202 and the receiver box 212.

Figure 3:
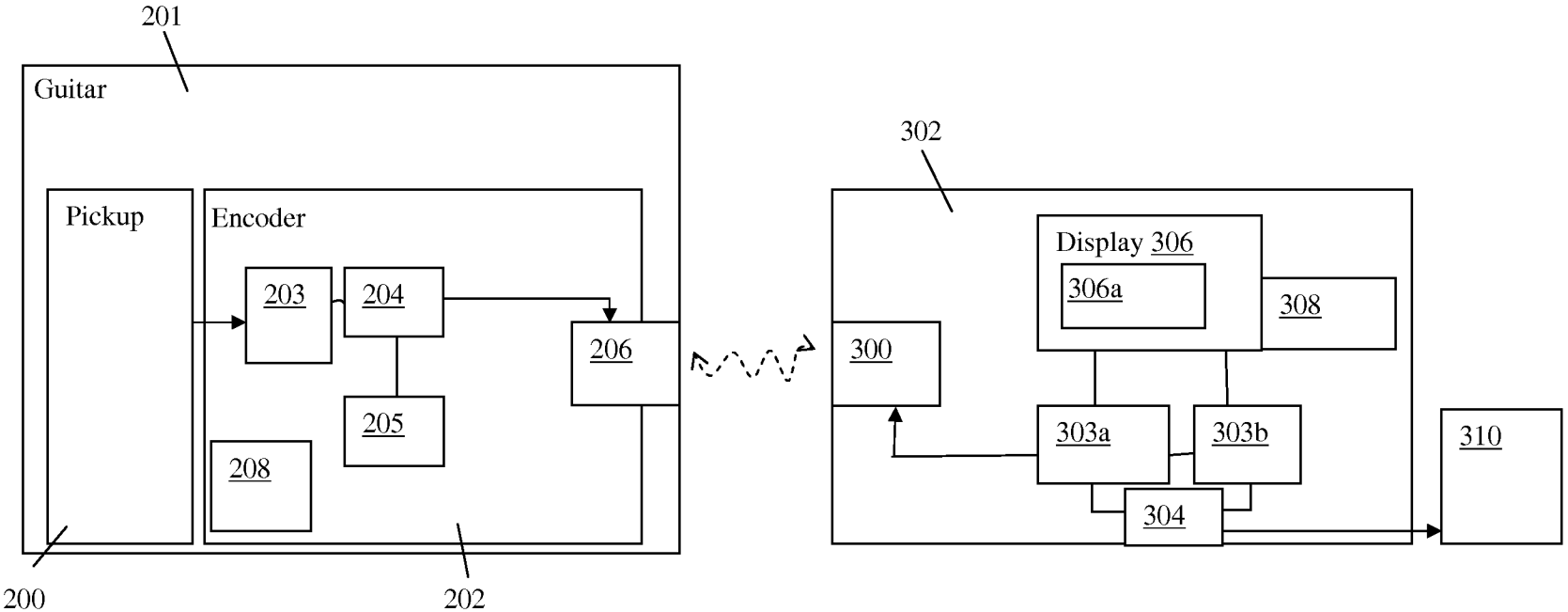
FIG. 3 is a schematic diagram of an audio or visual system using a personal computer, according to embodiments of the invention.

FIG. 3 is a schematic diagram of an audio or visual system using a personal computer, according to embodiments of the invention. The guitar 201, pickup 200, and encoder 202 may include similar or the same elements and have similar configuration as described in FIGS. 1 and 2. In some embodiments, transceiver 206 may transmit MIDI data or control data to a pen-drive or USB-drive acting as a receiver 300. The pen-drive receiver may be connected to a computer 302, such as a laptop computer or desktop computer. The computer 302 may include a processor 303*a* and memory 303*b* to implement software, such as a software synthesizer 304 or sampler. The software synthesizer 304 may work with or be compatible with audio editing or audio mixing software, which may also be implemented by processor 303*a* and memory 303*b*. A display 306 or user interface 306*a* may allow a user to input MIDI parameters that affect the conversion of electrical signals from pickup 200 to MIDI data. The display 306 or user interface 306*a* may work with input or control devices 308, such as computer keyboards or a mouse. Instead of being a USB pen drive, receiver 300 may be embedded or integrated on the computer, such as an internal wireless card, for example. Audio signals generated by synthesizer 304 and processor 303*a* may be output to a speaker or amplifier, or other output device 310.

Since data transmission of MIDI data may be wireless, pairing may need to be performed between transmitter-transceiver 206 and receiver-transceiver 210 or 300 in order for communication to occur on the same channel or frequency. Upon the initiation of pairing, the transmitter may being to send "I am here" messages on all available channels one by one, for a short time on each channel, incrementing one by one, and then repeating from the beginning. After sending the "I am here" message, transceiver 206 may evaluate if a second transceiver (e.g., 210 or 300) has hidden an "I hear you" message in the acknowledge signal that answers transceiver 206's message. If the acknowledgment signal is recognized, the pairing process may be completed with a "pairing finished" message transmitted to the receivers 210 or 300, and transceiver 206 may return to normal transmission mode. After receiving the "pairing finished" message, the receiver 210 or 300 may switch back to normal receive mode, and data communication may begin. The channel settings of both devices may be automatically stored after a pairing, and will be recalled on next power up.

Figures 4A, 4B:
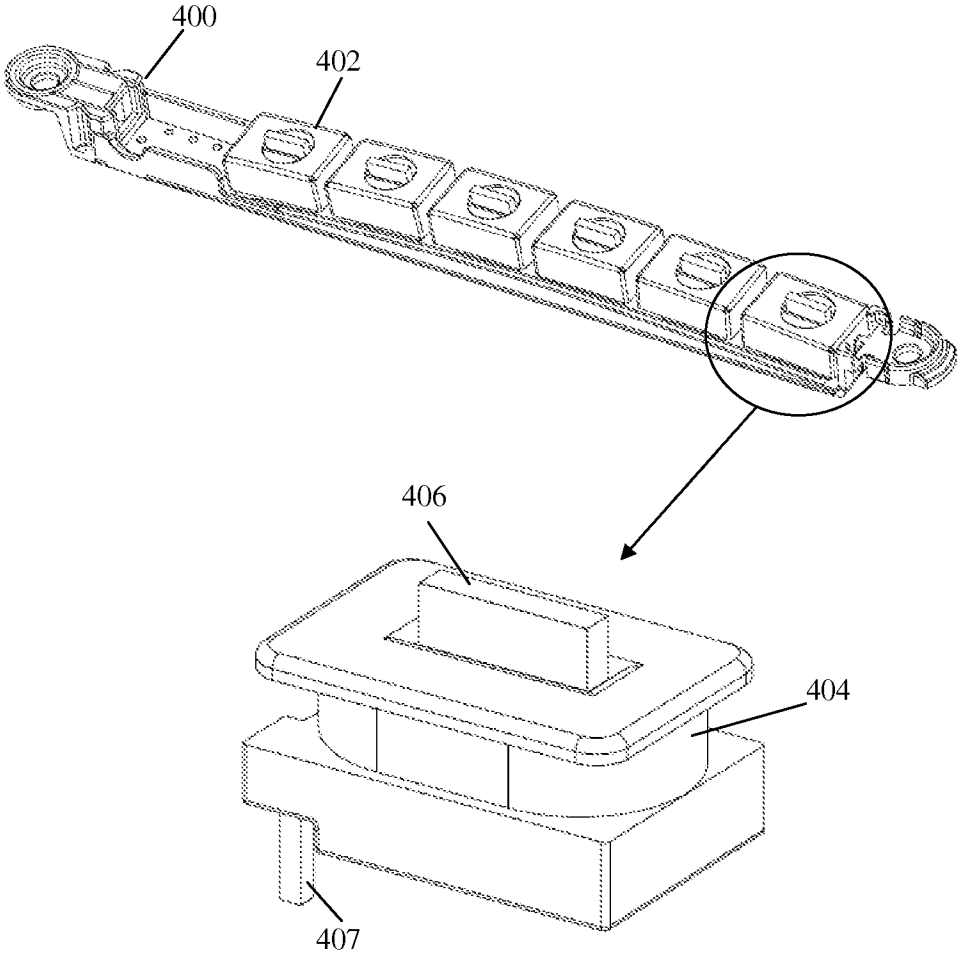
FIGS. 4A-4D are illustrations of an encoder and pickup, according to embodiments of the invention.

FIGS. 4A and 4B are illustrations of a guitar pickup 400, according to embodiments of the invention. A guitar pickup 400 may sense or detect vibrations from a guitar string as it is plucked. The pickup 400 may be mounted directly on the guitar, either by a user or embedded within the guitar at a time of manufacture. The pickup 400 may include a sensing coil unit 402 for each string that is being detected, for example. Each sensing coil unit 402 may include a wire coil 404 or other kind of coil (e.g., a printed coil) wrapped around a magnetic bar 406, which may have a magnetic field around it. As a metallic or soft metallic string vibrates near the magnetic bar 406, the vibrations may change the magnetic field around the magnetic bar 406 and induce a current within the wire coil 404. The current within the wire coil 404 may be transmitted or sent to an encoder or processor via a wire or connection 407 with the wire coil 404.

Figure 4C:
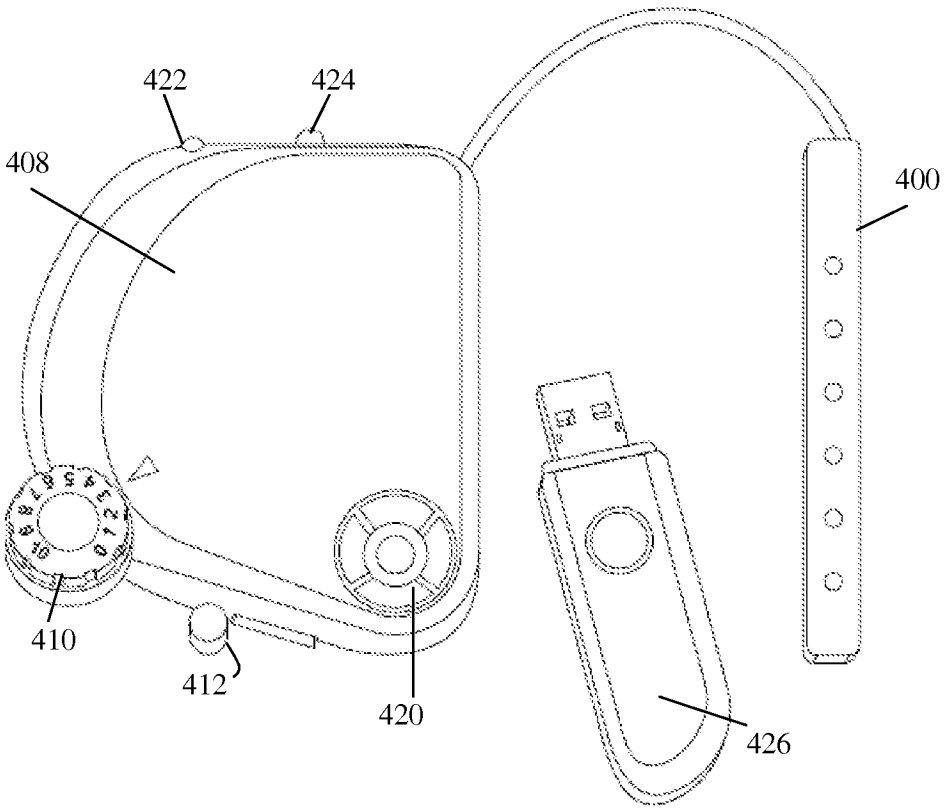

FIG. 4C is an illustration of an encoder 408 and pickup 400, according to embodiments of the invention. The pickup 400 may sense the sounds or vibrations of a nearby string on an instrument. The encoder 408 may include several controls to adjust MIDI parameters or other parameters. A volume knob 410 may set volume levels for each virtual instrument. A guitar/synth selector 412 switch may control which channels or voices are heard when the final synthesized sounds are produced. In a middle position, for example, a guitar voice and additional synthesized voices may be heard together. With guitar mode selected, the "synth" channels may be muted, and only the guitar's sounds may be heard. With synth mode selected, the guitar channel may be muted, and only virtual instruments may be heard. A set of control buttons 420 may allow navigation of a user interface or patch editing software on a separate computing device. A status light 422 may verify battery power and the connection between encoder and a receiver 426. A charge indicator LED or status light 424 may indicate when the encoder needs to be recharged. A receiver LED or status light may indicate or verify when the encoder is scanning for a connection with a wireless receiver 426. Other controls may be present on the encoder. The wireless receiver 426 may be a USB key or microUSB key that may be compatible with a computer or computer system (e.g., 212 or 302). The wireless receiver 426 may allow the encoder to transmit MIDI data to the computer for synthesis, for example.

Figure 4D:
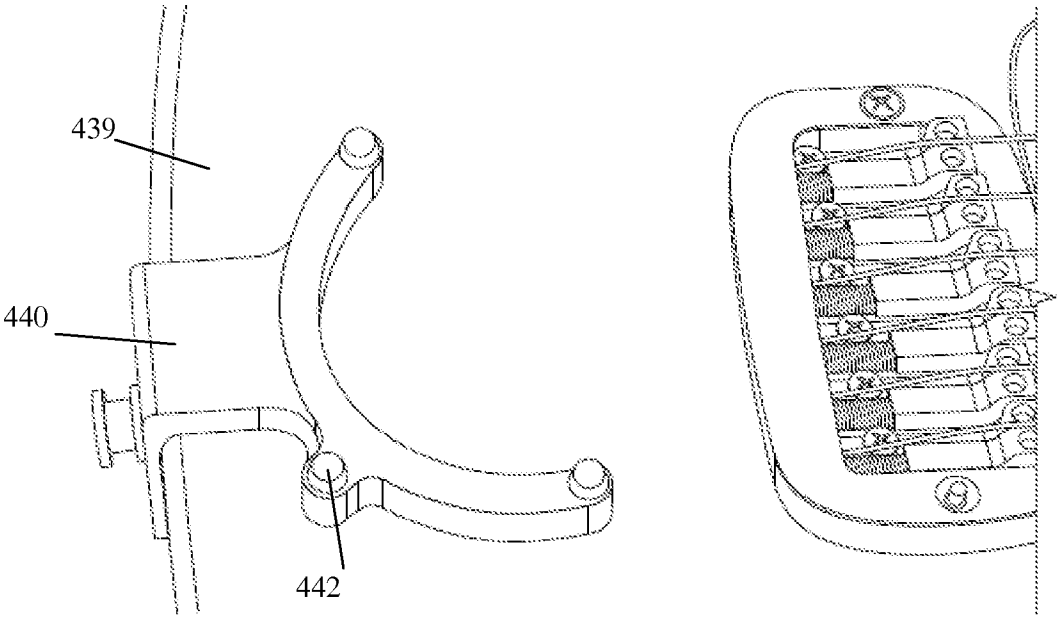

FIG. 4D illustrates a mounting device 440 on a guitar 439, according to embodiments of the invention. The mounting device 440 may be fixedly or stiffly attached to the guitar 439. An encoder may be attached to the guitar or instrument through mounting device 440. Magnets 442 may be located on the mounting device 440 to secure the encoder. The mounting device 440 may allow the user to removably attach the entire instrument portion (e.g., encoder and pickup) of the system to the instrument without damaging or altering the instrument. The mounting device 440 also allows the encoder and pickup to be removed from the instrument when they are not being used. The pickup may also include a separate mounting system for removably attaching it to the guitar 439 or instrument, or adjusting its closeness to the strings. In other embodiments, the pickup and encoder may be embedded within a guitar or other instrument at the time of manufacture.

Figure 5:
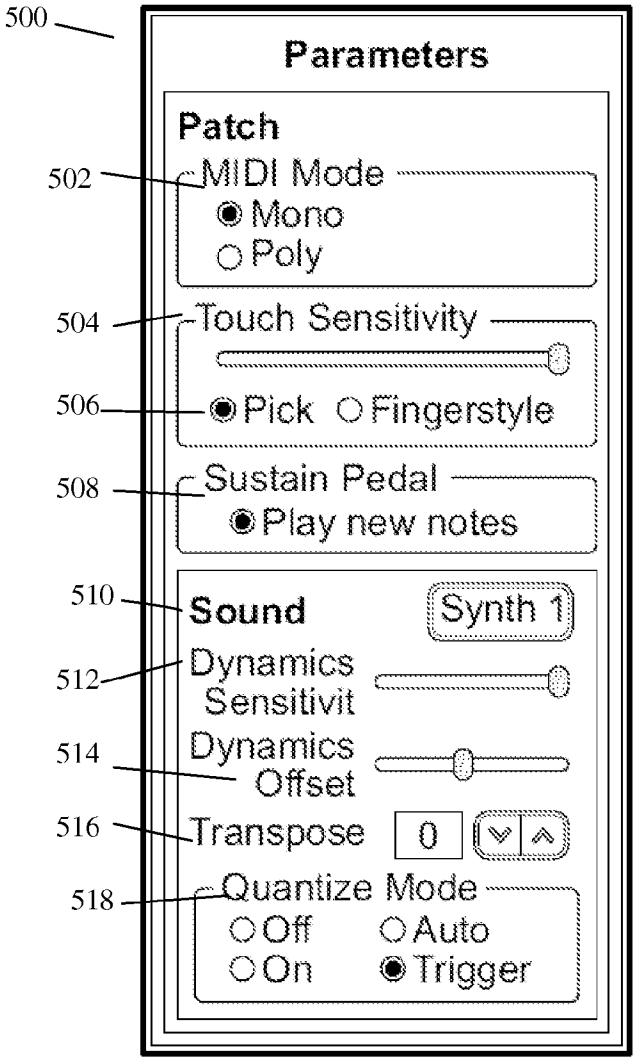
FIG. 5 is an example user interface for editing MIDI parameters, according to embodiments of the invention.

FIG. 5 is an example user interface 500 for editing MIDI parameters, according to embodiments of the invention. The user interface 500 may be integrated with a display on a computer or a standalone receiver box (see, e.g., FIGS. 2 and 3). The user interface 500 may allow users to edit MIDI or control parameters, or edit patches, which may be a set of MIDI or control parameters. The user may then transmit the patch to an encoder mounted on a guitar. Some control or MIDI parameters may include, for example (other parameters may be used):

Mode (e.g. MIDI Mode) Selector 502: Switchable between mono and poly. In poly mode, all channels (e.g., notes from all six strings of a guitar) may be sent with the same MIDI control messages. For example, all six strings of a guitar may be subject to the same pitch bend messages. In mono mode, each channel (e.g., each string) may include its own MIDI messages. For example, pitch bend may only apply to one of the strings.

Touch Sensitivity Control 504: Sets the dynamic response independently for each patch.

Pick/Fingerstyle Selector 506: Optimizes the touch response for pick or fingerstyle playing.

Sustain Pedal 508: sustains any note played (e.g., lengthens the time stamp of a note).

Sound Badge 510: Displays the channel or voice of the patch.

Dynamics Sensitivity Slider 512. Controls how the encoder interprets volume variations during playing. MIDI instruments may interpret volume on a scale of 0 to 127. With Dynamic Sensitivity on its rightmost setting, the maximum dynamic range may allow the loudest notes to transmit a value close to 127 (as loud as possible in one system), and softest notes may be closer to 0 (silence). With the slider at its center setting, every note may transmits a fixed value of for example 64; no matter how heavily or softly the instrument is played, all notes may have the same level. This may be useful when mimicking instruments with tones that do not change according to how hard a user plays, such as organs and harpsichords.

Dynamics Offset Slider 514. Shifts the entire dynamic scale (as defined by the Dynamic Sensitivity Slider) by e.g. ±64. The relative dynamic values are unchanged—everything gets louder or softer depending on the setting. (This would be useful if, say, you wanted a fixed-volume sound at a dynamic level other than the default setting of 64.)

Transpose Control 516. A user can transpose each synth independently from the others. Adjustable e.g. by ±1-24, with 1 representing a half-step, and 24 representing the maximum transposition of two octaves. (A user might, for example, dial in a setting of −12 for a bass tone to obtain notes below the regular range of the guitar, or a setting of +12 for a flute sound above the guitar's range.) Clicking the up and down arrows changes the transposition in half-step increments.

Quantize Mode Selector 518. Defines how TriplePlay interprets pitches that "fall between" the frets, such as bent notes and reverse bends. (Remember, however, that your results are also subject to the settings within your virtual instruments. Quantization mode settings can't override these individual plug-in settings.) in one embodiment there are four possible settings:

Off. Notes are not rounded to the nearest half-step.

On. Notes may be rounded to the nearest half-step.

Auto: A compromise between Quantize On and Quantize Off modes. Small pitch discrepancies may be ignored, similar to Quantize On mode. But if a pitch change seems more deliberate by a user, as in a note-bend, Quantize Off mode may be used, and the pitch of bends are reproduced.

Trigger. In this mode, no bends may be used. If, for example, if a user bends the note C up to D-flat, this may be interpreted as two separate notes with two separate attacks. This may be the best choice when mimicking instruments such as piano and organ, which may be unable to produce pitches that fall between adjacent half-steps.

Figure 6:
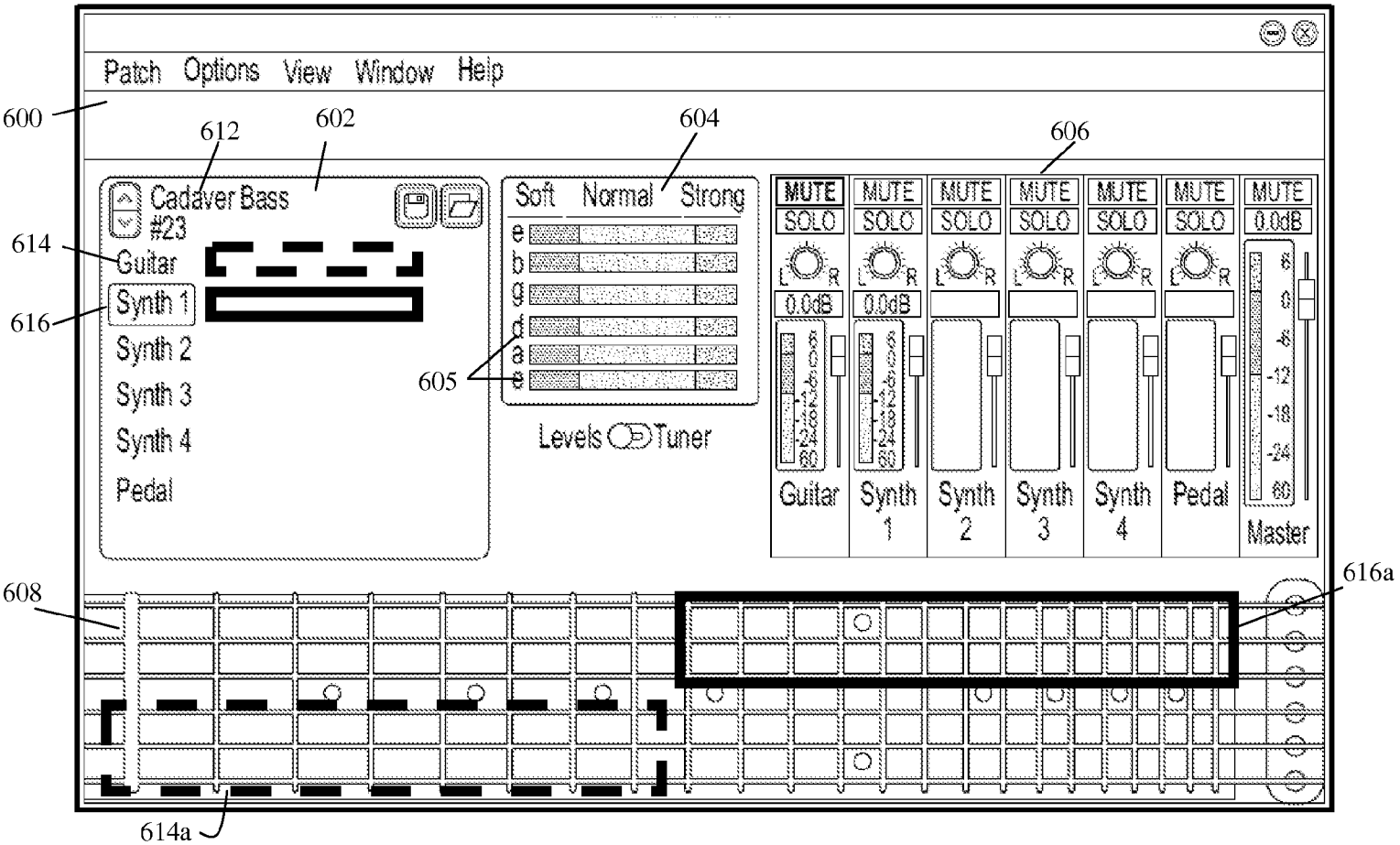
FIG. 6 is a user interface for editing MIDI parameters and mixing audio signals, according to embodiments of the invention.

FIG. 6 is a user interface 600 for editing music control message parameters such as MIDI parameters and for mixing audio signals, according to embodiments of the invention. User interface 600 may be displayed on a computer system (e.g., 110 or 302) or a receiver box (e.g., 212), for example. A patch readout area 602 may allow a user to preview, select, load, and save patches, for example to a computer or the encoder. A sensitivity adjustment area 604 may allow users to adjust dynamic sensitivity for each string 605 on a guitar. A mixer area 606 may allow a user to adjust the volume levels, panning, and solo/mute status of the guitar and synth sounds that may be included each patch. A fretboard/splits area 608 may display each note played in real time and may allow a user to create "splits"—patches that assign different sounds to different parts of the fretboard. For example, as shown, a patch 612 may be titled "Cadaver Bass". The patch 612 may include two voices, "guitar" 614 and "synth1" 616, which may be assigned to two different areas 614*a* and 616*a* on the fret board 608. For each voice, different sensitivity levels 604 may be set for each string 605. The volume levels may be adjusted between "guitar" and "synth1", e.g., the guitar may be at a less volume than the synth. The Cadaver Bass patch settings may be sent to an encoder on a guitar. As a musician plays the guitar, the notes that correspond to area 614*a* on the fretboard 608 may produce a guitar sound and the notes that correspond to area 616*a* on fretboard 608 may produce a synth sound. Other settings that are assigned to the areas may be sent as control data such as MIDI control messages by the encoder to a receiver. The fretboard 608 may also allow a user to assign audio or video samples or other audio or visual effects to particular areas of a guitar, so that when a user plays on the associated area on the guitar, it is possible for audio or video samples to concurrently play with the user. The user may also assign commands that control lighting, e.g. stage lighting, effects.

Figure 7:
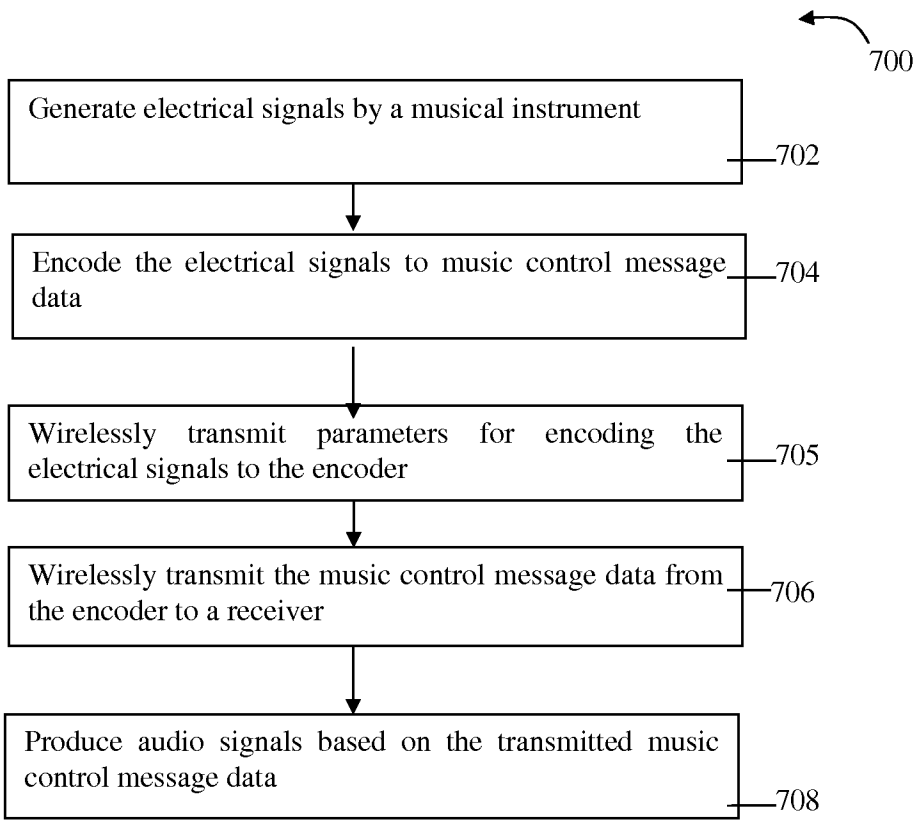
FIG. 7 is a flowchart of a method according to embodiments of the invention.

FIG. 7 is a flowchart of a method according to embodiments of the invention. In operation 702, a musical instrument may generate electrical signals. This may occur through a pickup attached to the instrument, and the pickup may sense or detect vibrations from the instrument and convert the vibrations to an electrical signal. In operation 704, the electrical signals may be encoded to music control data (e.g., control signal, message or MIDI data). The control or MIDI data may include information such as pitch and how long a note is played on the instrument. The MIDI data may include information such as pitch and how long a note is played on the instrument. In operation 705, a receiver, for example, may wirelessly transmit parameters for encoding the electrical signals to the encoder. In operation 706, the MIDI data may be wirelessly transmitted to a receiver. The receiver may be coupled to a processor or computer device that synthesizes audio signals. Operations 706 and 705 may be interchangeable in order, or may occur simultaneously or nearly simultaneously. In operation 708, the computer device may output or produce media signals such as audio signals, video signals, images, or lighting control messages based on the transmitted MIDI data. The computer device may further allow a user to edit MIDI parameters that affect how MIDI data is encoded from electrical signals generated by the instrument.

One or more processors may be used for processing, transmitting, receiving, editing, manipulating, synthesizing or patching digital or analog audio signals. The processor(s) may be coupled to one or more memory devices. Computers may include one or more controllers or processors, respectively, for executing operations and one or more memory units, respectively, for storing data and/or instructions (e.g., software) executable by a processor. The processors may include, for example, a central processing unit (CPU), a digital signal processor (DSP), a microprocessor, a controller, a chip, a microchip, an integrated circuit (IC), or any other suitable multi-purpose or specific processor or controller. Memory units may include, for example, a random access memory (RAM), a dynamic RAM (DRAM), a flash memory, a volatile memory, a non-volatile memory, a cache memory, a buffer, a short term memory unit, a long term memory unit, or other suitable memory units or storage units. Computers may include one or more input devices, for receiving input from a user or agent (e.g., via a pointing device, click-wheel or mouse, keys, touch screen, recorder/microphone, other input components) and output devices for displaying data to a customer and agent, respectively.

In additional embodiments, the present technology may be directed to non-transitory computer readable storage mediums that include a computer program embodied thereon. In some embodiments, the computer program may be executable by a processor in a computing system to perform the methods described herein.

What is claimed is:

1. A musical instrument, comprising:

a pickup positioned on, partially within, or within a body of the musical instrument, the pickup configured to receive vibrational signals generated by the instrument and translate the vibrational signals into electrical signals that are indicative of the vibrational signals;

an encoder positioned on, partially within, or within the body of the musical instrument and coupled to the pickup to encode the electrical signals received by the pickup into music control message data prior to transmission of the music control data from the instrument; and a first wireless transceiver positioned on, partially within, or within the body of the musical instrument and coupled to the encoder to wirelessly transmit the music control message data to a second wireless transceiver that is not positioned on, partially within, or within the body of the musical instrument, wherein the media signals are capable of being produced based on the music control message data.

2. The musical instrument of claim 1, wherein the music control message data conforms to a Music Instrument Digital Interface (MIDI) format.

3. The musical instrument of claim 1, comprising a pickup device to detect sound created by the instrument and convert the sound to electrical signals encoded by the encoder.

4. The musical instrument of claim 1, wherein the media signals include signals for audio, video, or lightening effects.

5. The musical instrument of claim 1, wherein the second transceiver is to transmit MIDI parameters to the first transceiver.

6. The musical instrument of claim 1, wherein the encoder includes memory to store parameters for encoding the electrical signals to the music control message data.

7. The musical instrument of claim 1, wherein the encoder includes controls to select MIDI parameters.

8. The musical instrument of claim 1, wherein the processor is comprised in a stomp box, the stomp box comprising a synthesizer or sample player and foot switches for controlling or editing MIDI parameters.

9. The audio or visual system of claim 1 wherein, after a predetermined period of time has elapsed without the first wireless transmitter transmitting a message to the second wireless receiver, the first wireless transceiver transmits a message that does not include any music control message data to the second wireless transceiver.

10. The audio or visual system of claim 9 wherein the predetermined period of time is based on a maximum amount of transmission delay between a command input at the second wireless receiver and receipt of the command by the first wireless transceiver that ensures a player of the instrument does not experience a delay in response to the command when playing.

11. A method, comprising:

generating vibrational signals by a musical instrument;

translating, by a pickup positioned on, partially within, or within a body of the musical instrument, the vibrational signals into electrical signals that are indicative of the vibrational signals;

encoding, by an encoder positioned on, partially within, or within the body of the musical instrument and coupled to the pickup, the electrical signals to music control message data prior to transmission of the music control data from the instrument; and wirelessly transmitting, by a first wireless transceiver positioned on, partially within, or within the body of the musical instrument the musical instrument and coupled to the encoder to transmit the music control message data from the encoder to a second wireless transceiver that is not positioned on, partially within, or within the body of the instrument, wherein the media signals are capable of being produced based on the music control message data.

12. The method of claim 11, wherein the music control message data conforms to a MIDI data format.

13. The method of claim 11, comprising editing, by a processor, MIDI parameters for encoding the electrical signals to MIDI data.

14. The method of claim 11, comprising generating electrical signals by the musical instrument, wherein each string on the musical instrument generates separate electrical signals.

15. The method of claim 11, comprising storing, in memory coupled to the encoder, one or more sets of MIDI parameters for encoding the electrical signals to MIDI data.

16. The method of claim 11, wherein the instrument is an electric guitar.

17. A system, comprising:

a MIDI encoder coupled to a pickup, the MIDI encoder and the pickup positioned on, partially within, or within a body of an electric musical instrument, the pickup configured to translate vibrational signals generated by the electric musical instrument into electrical signals and the MIDI encoder configured to encode the electrical signals into MIDI data prior to transmission of the MIDI data from the electrical music instrument; and a first wireless transceiver positioned on, partially within, or within the body of the electric music instrument and coupled to the MIDI encoder to receive MIDI data from the MIDI encoder and wirelessly transmit the MIDI data to a second wireless transceiver that is not positioned on, partially within, or within body of the electric musical instrument, wherein the second wireless transceiver is configured to transmit MIDI parameters to the first wireless transceiver.

18. The system of claim 17, wherein the second wireless transceiver is coupled to a computing system, comprising a processor and memory, configured to display a visualization of MIDI parameters associated with the received MIDI data.

19. The system of claim 18, wherein the computing system is configured to synthesize the MIDI data into media signals.

20. The system of claim 18, wherein the computing system is configured to allow editing of the MIDI parameters.

* * * * *